US005123347A

United States Patent [19]

Brown

[11] Patent Number: 5,123,347

[45] Date of Patent: Jun. 23, 1992

[54] SCORING OR PERFORATING BAR FOR OFFSET PRESSES

[76] Inventor: William R. Brown, 4815 W. 61st Ter., Mission, Kans. 66205

[21] Appl. No.: 700,538

[22] Filed: May 14, 1991

[51] Int. Cl.[5] ..... B41F 13/54

[52] U.S. Cl. ..... 101/226; 101/224

[58] Field of Search ..... 101/226, 224, 227; 83/343, 346, 660, 678; 493/324, 325

[56] References Cited

U.S. PATENT DOCUMENTS

| | | |
|---|---|---|
| 753,061 | 2/1904 | Gates . |
| 2,007,544 | 7/1935 | Meisel . |
| 2,469,526 | 5/1949 | Sloat . |
| 2,832,411 | 4/1958 | Richards et al. . |
| 2,842,202 | 7/1958 | Boyd . |
| 3,554,070 | 1/1971 | Boyd . |
| 4,596,546 | 6/1986 | Schellenberg . |
| 4,767,159 | 6/1987 | Nawrath . |
| 4,936,214 | 6/1990 | Overholser . |
| 4,962,686 | 10/1990 | Boyd et al. . |

*Primary Examiner*—Edgar S. Burr
*Assistant Examiner*—Anthony H. Nguyen

[57] ABSTRACT

A score or perforator bar device is adapted for use with certain printing presses having a blanket cylinder revolving upon an axle shaft and with an elongate slot for attachment of the blanket. The adapter device includes a bar of a length substantially the same as the cylinder with a working side having a longitudinal slot for mounting a knife blade. The knife blade has either a scoring edge or a perforation edge, depending upon the desired effect. The bar has an attachment side for connection to the blanket cylinder and has legs extending generally perpendicularly. The legs have recessed ends for bearing against the cylinder shaft so that the force of the blade is transferred to the axle shaft and not to the cylinder shell. A screw arrangement retains the bar in a cylinder slot.

8 Claims, 4 Drawing Sheets

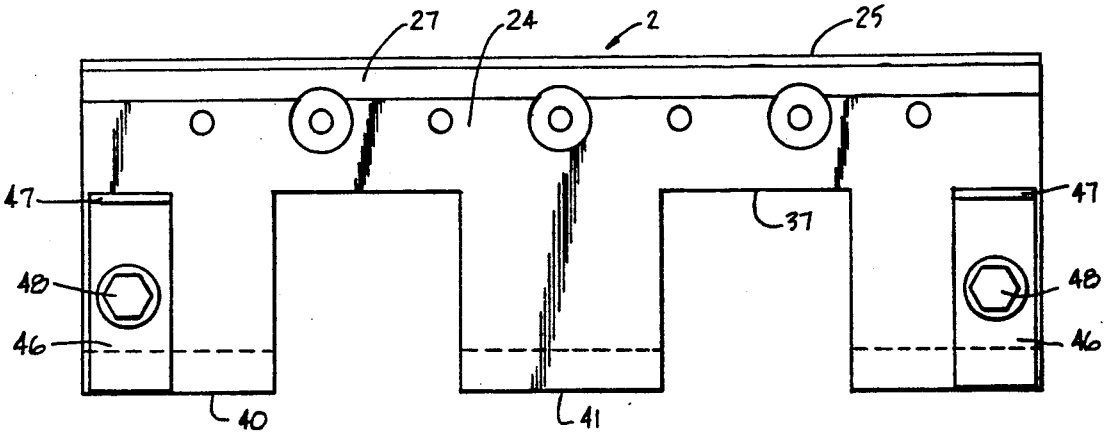
Fig. 5
Fig. 6
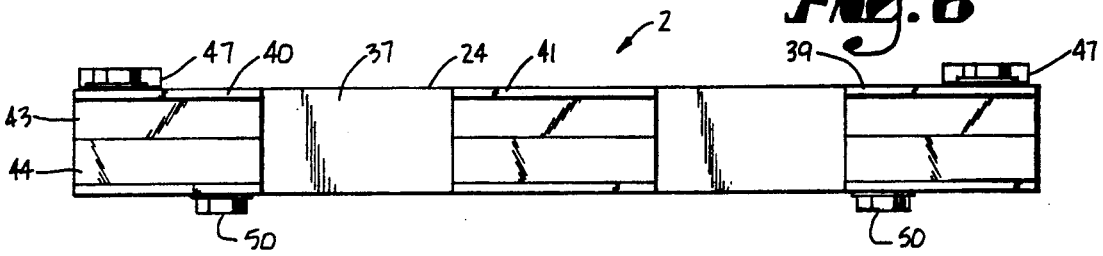
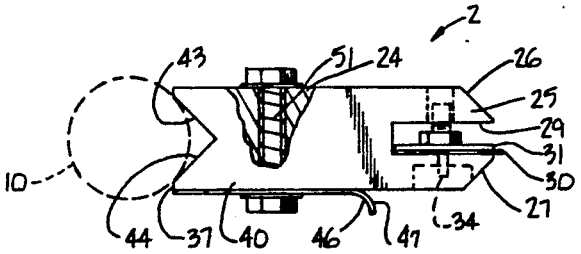
Fig. 7
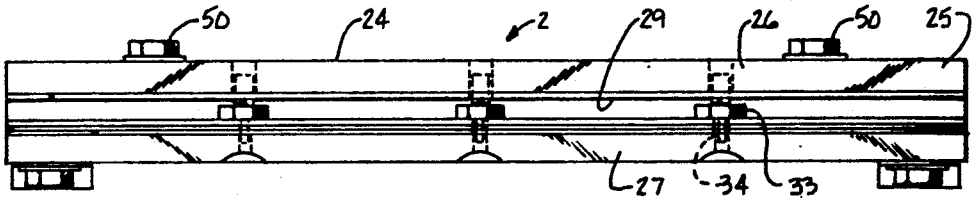
Fig. 8

SCORING OR PERFORATING BAR FOR OFFSET PRESSES

FIELD OF THE INVENTION

This invention relates to printing presses in general and in particular to a perforating and scoring blade for printing presses.

BACKGROUND OF THE INVENTION

Offset or lithographic printing presses have been in common use for many years. Indeed, the A. B. Dick printing presses, models 360 and 9800 series with chain delivery are perhaps the most common presses in use. These presses include an upper plate cylinder, a blanket cylinder and a lower impression cylinder. The blanket cylinder is a shell cylinder; that is, it is formed of an outer cylinder wall or shell with an inner central axle shaft. Radial lugs connect the shell to the inner shaft. The blanket cylinder is relatively expensive and the shell can be deformed upon excessive weight bearing or use. The present invention provides a perforated scoring adapter bar which readily and easily fits onto the blanket cylinder. Installation does not require disassembly of the printing press in any way and the job is inexpensively and easily accomplished. Moreover, the disclosed perforating and scoring adapter bar does not place undue stress or wear upon the blanket cylinder and all stresses are born by the sturdy blanket cylinder axle shaft, rather than by the more easily damaged cylindrical shell.

OBJECTS OF THE INVENTION

Principal objects of the present invention are: to provide an adapter bar for a printing press which is capable of either scoring or perforating operations; to provide such an adapter bar which fits easily and readily within the longitudinal slot on a blanket cylinder; to provide such an adapter bar in which scoring and perforating forces are transferred to the sturdy axle shaft of the blanket cylinder; to provide such an adapter bar in which the perforating and scoring rules may be used over and over again until becoming too dull to do a satisfactory job; to provide such an adapter bar in which the press is always ready to receive the bar without any previous preparation such as removing blankets or replacing the blankets when finished; to provide such an adapter bar which can be installed and replaced within a few minutes; and to provide such an adapter bar which is easy to use, economical and readily replaced.

Other objects and advantages of this invention will become apparent after considering the following disclosure.

DESCRIPTION OF THE DRAWINGS

FIG. 5 is a bottom plan view of the adapter bar.

FIG. 6 is a rear elevational view of the adapter bar.

FIG. 7 is a side elevational view of the adapter bar.

FIG. 8 is a front elevational view of the adapter bar.

DESCRIPTION OF THE PREFERRED AND ALTERED EMBODIMENT

As required, a detailed embodiment of the present invention is disclosed herein. It is, however, to be understood that the disclosed embodiment is merely illustrative of the invention, which may be embodied in various forms. Therefore, specific structural and functional details disclosed herein are not to be interpreted as limiting, but merely as providing the proper basis for the claims and as a representative basis for teaching one skilled in the art to employ the scoring or perforating bar for offset presses in virtually any appropriately specific and detailed structure.

Figure 1:
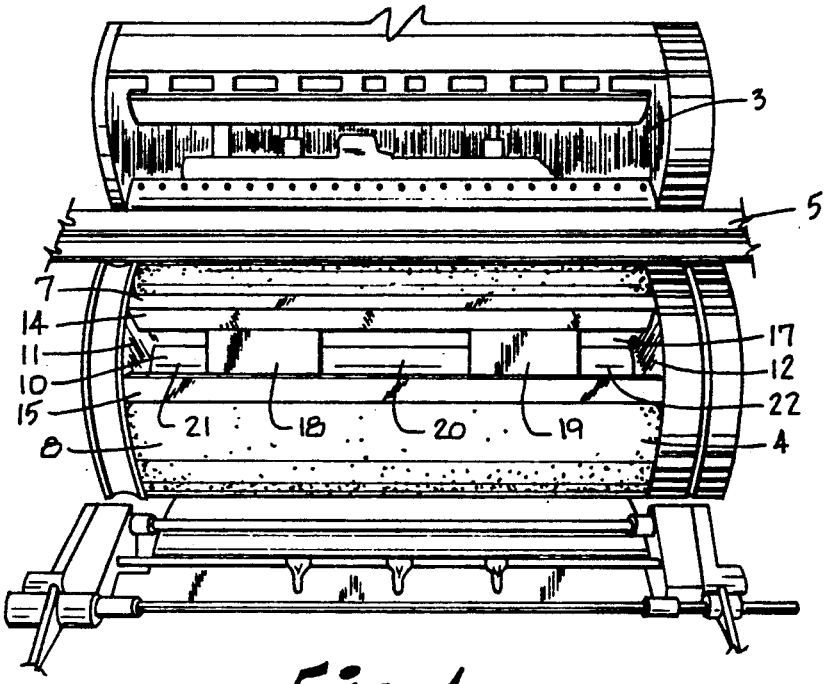
FIG. 1 is a front elevational view of a printing press shown ready to receive the adapter bar of the present invention.

FIG. 1, numeral is directed to an offset or lithographic printing press and in particular, depicts an A. B. Dick printing press Model 360.

Figure 2:
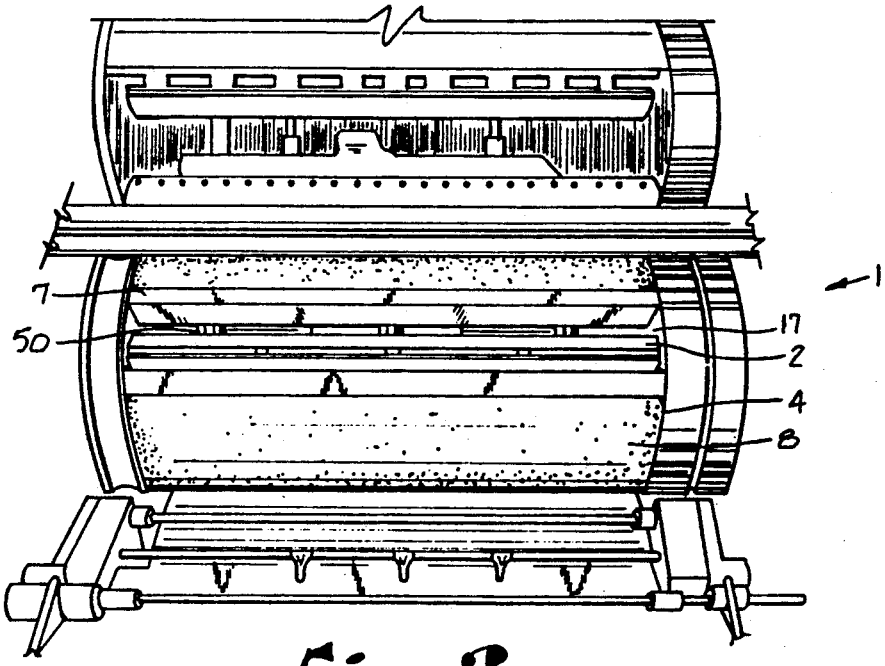
FIG. 2 is an elevational view of a printing press with an adapter bar of the present invention installed.
Figure 3:
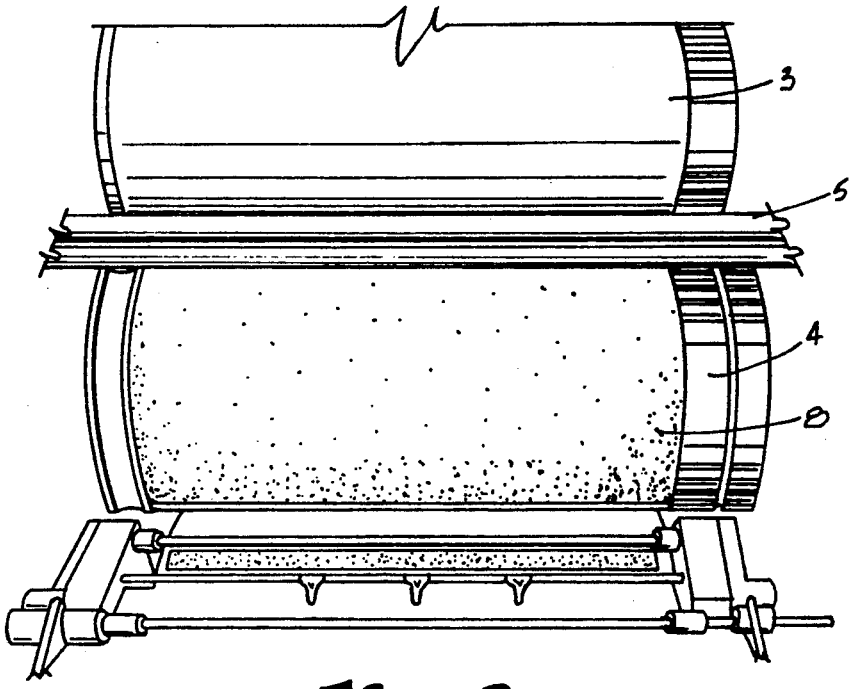
FIG. 3 is an elevational view of a printing press in similar rotational view.
Figure 4:
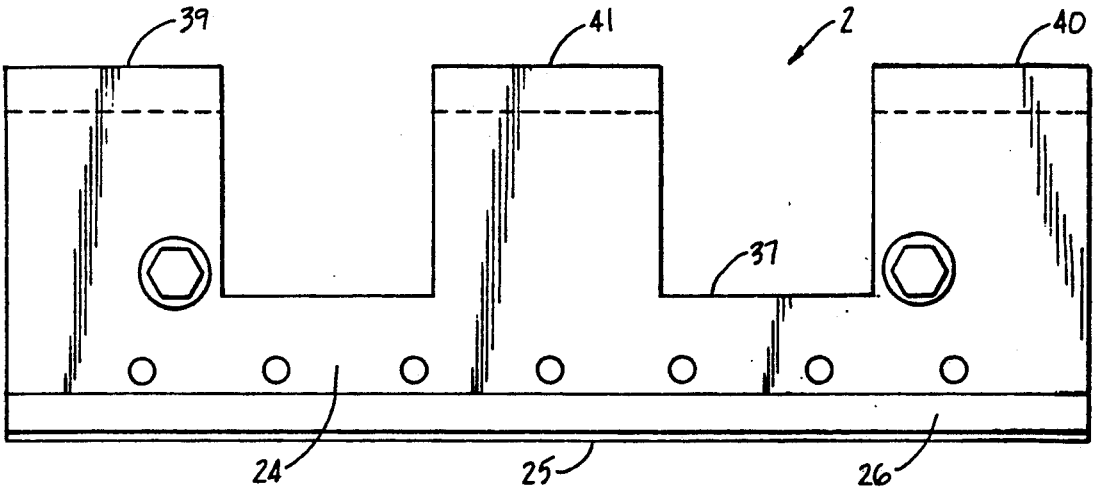
FIG. 4 is a plan view showing the adapter bar of the present invention.

FIG. 2 discloses the printing press 1 with a scoring or perforating bar device 2 comprising the present invention mounted therein. The bar device 2 is particularly adapted for use on A. B. Dick printing presses, models 360 and 9800 series with a chain delivery, although the concept of the invention could be utilized with numerous other press configurations.

Referring to FIG. 1, the press includes an upper plate cylinder 3, a blanket cylinder 4, both supported within the press by a framework 5, and a lower impression cylinder (not shown).

The blanket cylinder 4 is a hollow or shell cylinder, having an outer front of a shell 7, about which a blanket 8 is affixed. The blanket cylinder 4 rotates upon a central axle shaft 10 and has opposite end walls 11 and 12. Attached to and extending downwardly or inwardly from the shell 7 are edge bars 14 and 15 which are parallel and form a space or blanket cylinder gap 17 therebetween for purposes hereinafter described. The edge bars 14 and 15 respectively abut the shell 7 over which the blanket 8 is mounted. Webs 18 and 19 extend radially into the blanket cylinder 4 and support the shell 7 relative to the axle shaft 10. In the illustrated example, the webs 18 and 19 are spaced and form a center space 20 and opposite end spaces 21 and 22 adjacent the end walls of 11 and 12.

Referring to FIG. 2, the bar device 2 fits within the blanket cylinder gap 17.

Figure 11:
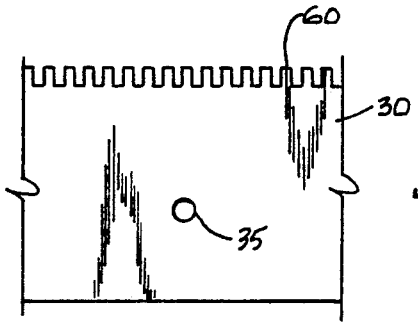
FIG. 11 is a fragmentary view showing a form of blade which may be emplaced within the adapter bar.

The bar device 2 is shown in more detail with respect to FIGS. 4 through 8, and generally includes an elongate bar 24 of a length substantially the same as the blanket cylinder 4 to which the bar 24 is to be affixed. The bar 24 has a working side 25 with beveled edges 26 and 27. Working side 25 has a longitudinal slot 29 extending its length, in which may be mounted blades or rules, such as a scoring or a perforation blade 30. To contain the blade 30 within the slot 29, a backing strip or spacer 31 is positioned parallel and against the blade 30 and the blade 30 and spacer 31 pinched against a wall of the slot 29 by a headed screw 33. Preferably, the headed screw 33 includes a short, axially extending nub 34 which extends through a hole 35 in the blade 30. FIG. 11, and helps insure that the blade 30 does not inadvertently become loose from the blade retaining slot 29. In the illustrated example, there are screws maintaining the blade 30 within the slot 29.

The bar device 2 also has an attachment side 37 including a plurality of legs, such as opposite end legs 39 and 40 and middle leg 41 which extend generally perpendicularly to the longitudinal axis of the bar 24. The legs 39, 40 and 41 have ends with recesses, such formed by beveled faces 43 and 44 for resting upon and cradling the axle shaft 10. The legs 39, 40 and 41 are spaced so as to straddle the webs 18 and 19 within the blanket cylinder 4.

In the example shown in FIG. 7, a clip 46 with outwardly projecting fingers 47 is fixed to each of the end legs 39 and 40 and is designed to rest against the underside of the shell 7 when the bar device 2 is positioned within the blanket cylinder gap 17 The clips 46 are preferably of springy material for ease of construction and are affixed to the bar 24 as by bolts 48.

The bar device 2 is held within the blanket cylinder gap 17 by wedging, that is, the bar 24 has two headed bolts 50 received in threaded bores and which can be backed out of the bores so that the bolt heads engage the opposite wall of the blanket cylinder gap 17, as shown in FIG. 2. The coil springs 51 bias the bolt to an outward position. This wedging effect enables the bar device 2 to be mounted within the gap 17 without using bolt or screw holes in the cylinder gap walls which can wear out or become loose with use.

Figure 9:
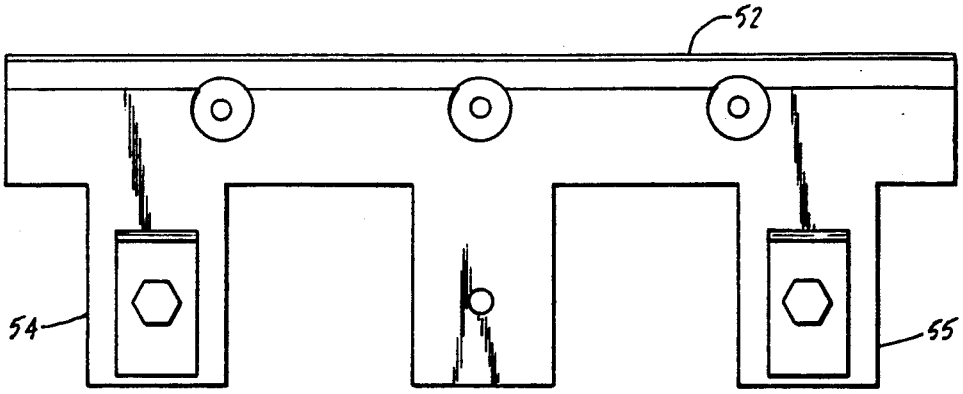
FIG. 9 is a top plan view of an alternative embodiment of the adapter bar.

The bar device 2 can be readily adapted for use with different configurations of blanket cylinders. For example, in FIG. 9 is shown a bar device 52 which is substantially identical in configuration to the bar device 2 with the exception that the end legs 54 and 55 are not positioned all the way at the opposite ends of the bar 24, as is shown in connection with FIGS. 5 through 8, but are instead inset a slight amount such to conform to a different configuration of blanket cylinder gap.

Figure 10:
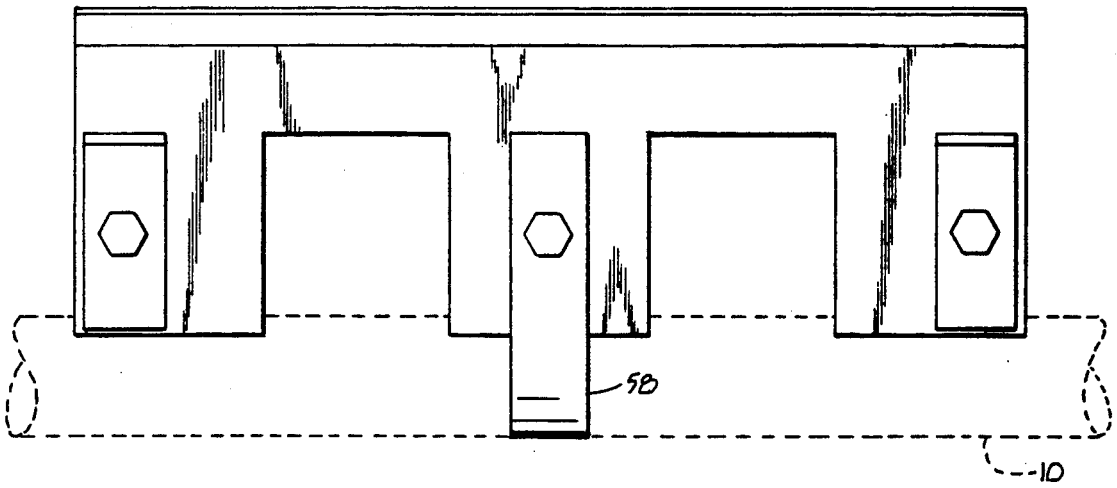
FIG. 10 is a second front elevational view of an embodiment of the adapter bar.

In FIG. 10 is shown a connector clip 58 which can be used in connection with either of the configurations shown in FIG. 5 through 8 or FIG. 9. The connector clip 58 is a spaced, resilient spring clip with opposed arcuate fingers which resiliently clip about the axle shaft 10 when the bar device 2 is mounted within the blanket cylinder gap 17. In some installations, the connector clip 58 may be helpful in retaining the bar device 2 in a proper position connected to the axle shaft 10.

In FIG. 11 is shown a blade 30 having an edge 60, particularly adapted for creating a perforation line in a web of printed paper material moving between the blanket cylinder 4 and the lower impression cylinder (not shown). It will be appreciated that to make a scoreline, the blade edge 60 would be a smooth edge.

The bar device 2 is fast and easy to install and is simply inserted through the blanket cylinder gap 17 until the recesses on the leg ends fix firmly upon the axle shaft 10. The mounting clips 46 may include elongate bolt holed slots so that upon loosening and tightening the bolts 48, the clips 46 can be adjusted upwardly and downwardly to stabilize the bar device 2 within the gap 17 and to properly position the bar 2 relative to the edge of the blanket cylinder shell 7. The headed bolts 50 are rotated outwardly to press against the opposite wall of the gap 17. The bar device 2 is thereby installed in the gap 17 and is ready to provide a straight and effective score and perforation device. No removal of blankets is necessary or even desirable in order to fit the bar device 2 into the blanket cylinder gap 17. Moreover, any impact caused by printing is directed through the bar device 2 through the axle shaft 10 and not to the cylinder shell 7. The force of the perforation or score is thus absorbed by the strongest part of the blanket cylinder 4 and preserves the shell 7 from any deformation or weakening.

Blades 30 with different score or perforation edges may be used over and over again, since they are not attached by adhesive or otherwise semipermanently affixed within the bar device slot 29. Removal and replacement of the blade 30 within the slot 29 is easily and quickly accomplished by backing out and retightening of the screws 33. Removal and replacement of the blades 30 can be accomplished without the removal of the bar device 2 from an installed position in the blanket cylinder gap 17.

It is to be understood that while certain forms of this invention have been illustrated and described, the invention is not limited thereto, except insofar as such limitations are included in the following claims.

What is claimed and desired to be secured by Letters Patent is as follows:

1. A score or perforator bar device which can be affixed to the blanket cylinder of an offset or lithographic press or the like for forming score or perforation lines in paper passing through the press and wherein the cylinder has a central shaft and an elongate slot for attachment of a blanket, the device comprising:

a) an elongate bar having a length substantially the same as the blanket cylinder to which said bar is to be affixed;

b) said bar having a working side with a longitudinal slot for mounting a knife blade having an edge for forming score or perforation lines;

c) said bar having an attachment side with legs extending generally perpendicularly therefrom, said legs having ends for bearing against said cylinder shaft; and d) means retaining said bar in said slot of said cylinder.

2. The bar device set forth in claim 1 wherein said ends of said legs include a recess for cradling and receiving said shaft.

3. The bar device set forth in claim 1 including means extending from said ends of said legs for extending about said shaft.

4. The bar device set forth in claim 3 wherein said means extending from said ends is a resilient, spring clip with opposed, arcuate fingers.

5. The bar device set forth in claim 1 wherein said means retaining said bar in said slot is a spring biased bolt extendable to wedge said bar in said slot.

6. The bar device set forth in claim 1 including a plurality of bolts detachably mounting said blade within said longitudinal slot.

7. A score or perforator bar device which can be affixed to the blanket cylinder of an offset or lithographic press or the like for forming score or perforation lines in paper passing through the press and wherein the cylinder has a central axle shaft and an elongate slot for attachment of a blanket, the device comprising:

a) an elongate bar having a length substantially the same as the blanket cylinder to which said bar is to be affixed;

b) said bar having a working side with a longitudinal slot for mounting a knife blade having an edge for forming score or perforation lines, said blades being bolted into said longitudinal slot;

c) said bar having an attachment side with at least two spaced legs extending generally perpendicularly therefrom, said legs having ends with recesses for cradling partially about said central axle shaft and bearing thereon.

d) screw means extending from said bar for retaining said bar in said elongated slot of said cylinder.

8. The bar device set forth in claim 7 including a medial leg extending from said attachment side and having an end recess for bearing against said cylinder shaft, said medial leg having a resilient spring clip extending therefrom with opposed, arcuate fingers extending therefrom for clipping about said cylinder shaft.

* * * * *